United States Patent [19]

Luchaco et al.

[11] 3,971,354

[45] July 27, 1976

[54] INCREASING WARM UP ENRICHMENT AS A FUNCTION OF MANIFOLD ABSOLUTE PRESSURE

[75] Inventors: David G. Luchaco, Rochester; William A. Peterson, Jr., Troy, both of Mich.

[73] Assignee: The Bendix Corporation, Southfield, Mich.

[22] Filed: June 23, 1975

[21] Appl. No.: 589,174

[52] U.S. Cl. ..... 123/179 L; 123/32 EA

[51] Int. Cl.[2] ..... F02B 3/00

[58] Field of Search..... 123/32 EA, 179 L, 179 G

[56] References Cited

UNITED STATES PATENTS

| | | | |
|---|---|---|---|
| 3,566,846 | 2/1971 | Glockler | 123/32 EA |
| 3,734,068 | 5/1973 | Reddy | 123/179 L |
| 3,816,717 | 6/1974 | Yoshida | 123/32 EA |
| 3,931,808 | 1/1976 | Rachel | 123/179 L |

*Primary Examiner*—Charles J. Myhre
*Assistant Examiner*—Ronald B. Cox
*Attorney, Agent, or Firm*—James R. Ignatowski

[57] ABSTRACT

An electronic fuel control system for an internal combustion engine is disclosed capable of providing an enriched fuel/air mixture to the engine as a function of the engine's temperature and the engine's load during the transient warm up period. The fuel control unit embodies a full load warm up enrichment circuit controlling, in response to engine temperatures below a predetermined temperature and engine loads as determined from the pressure in the engine's intake manifold, the quantity of fuel being delivered to the engine. In the preferred embodiment the full load warm up enrichment circuit is a current sink sinking a portion of the current charging the injection timing capacitor in the electronic control unit to increase the duration of the generated injection fuel delivery pulses.

23 Claims, 16 Drawing Figures

FIG. 6
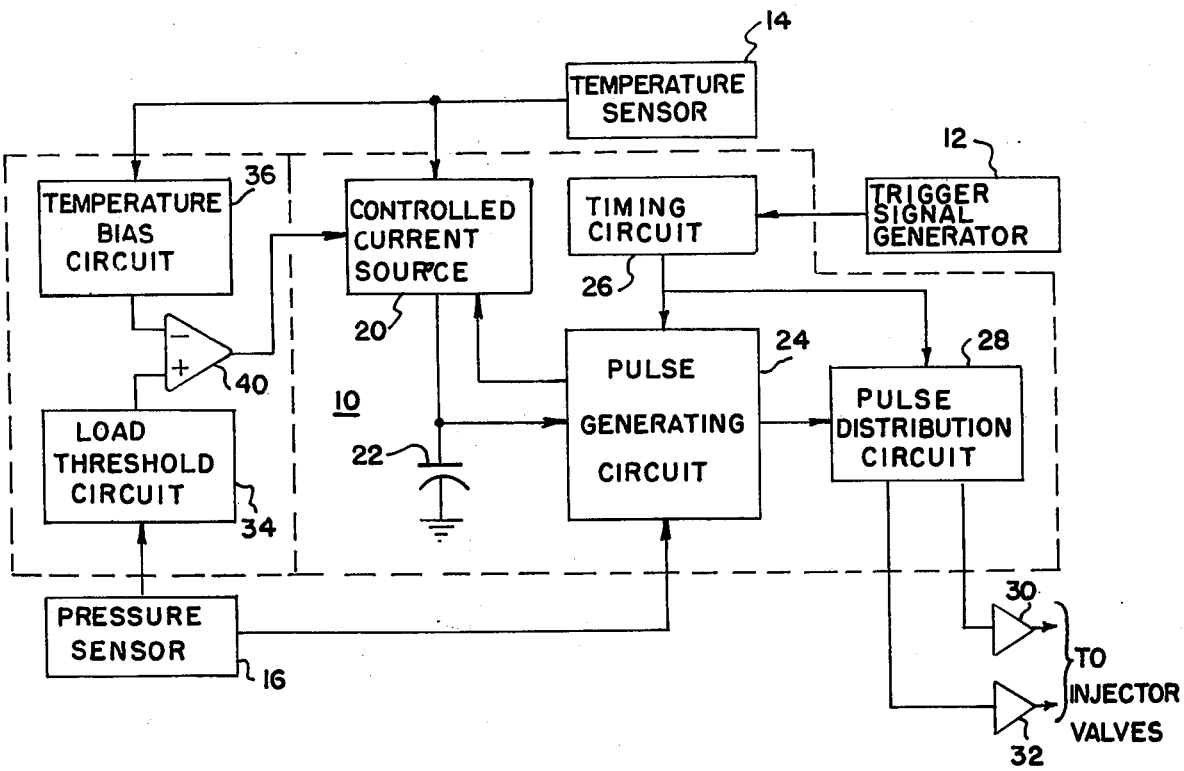
FIG. 7
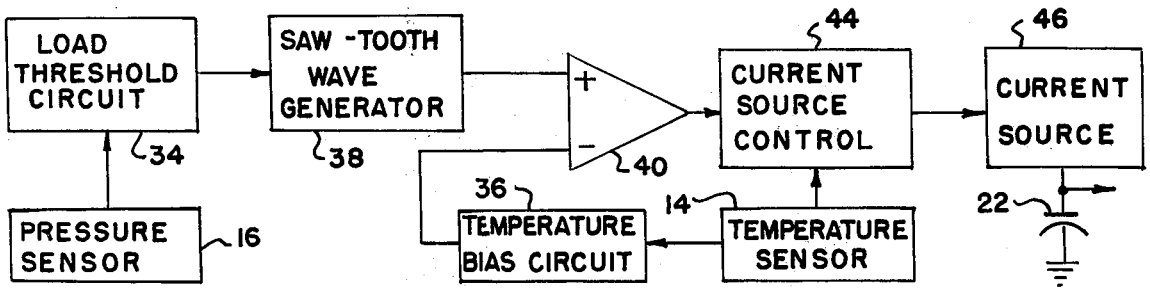
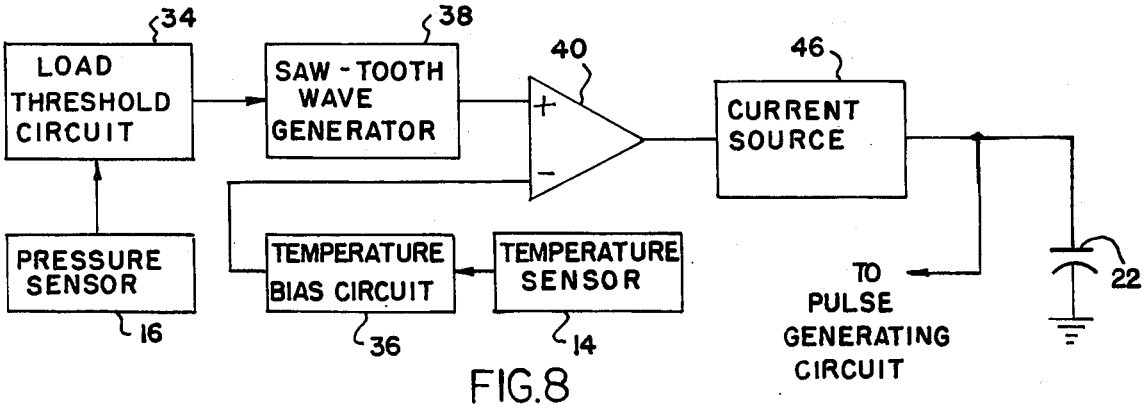
FIG. 8

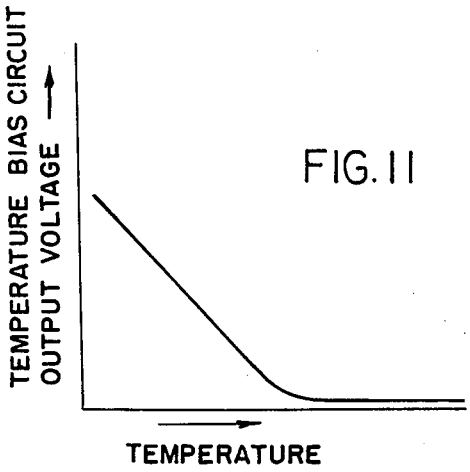
FIG. 11
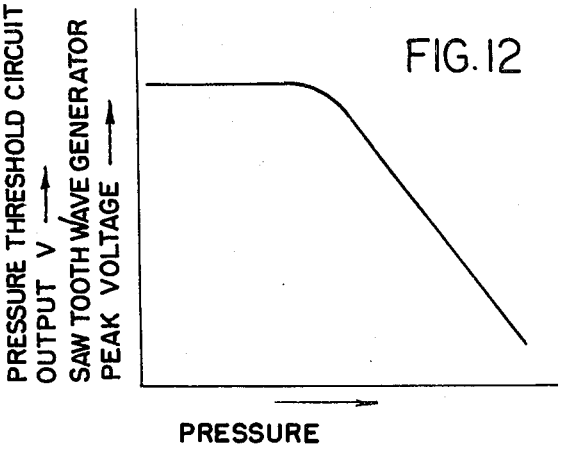
FIG. 12
FIG. 13a
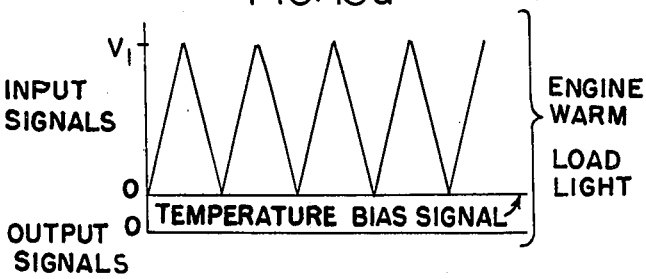
FIG. 13b
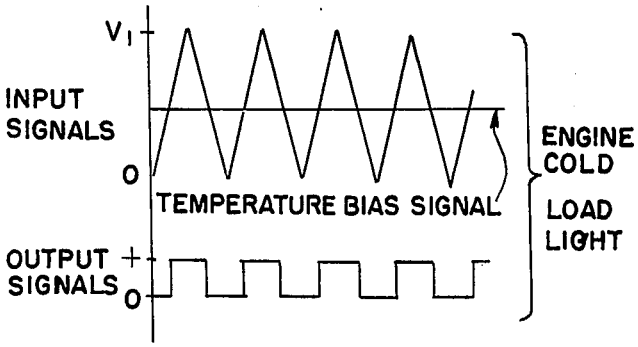
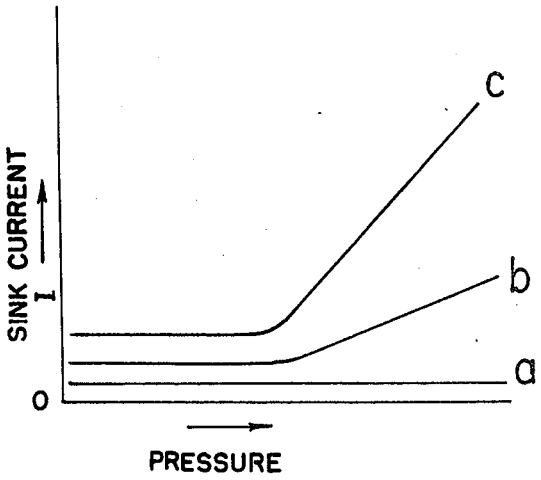
FIG. 14
FIG. 13c
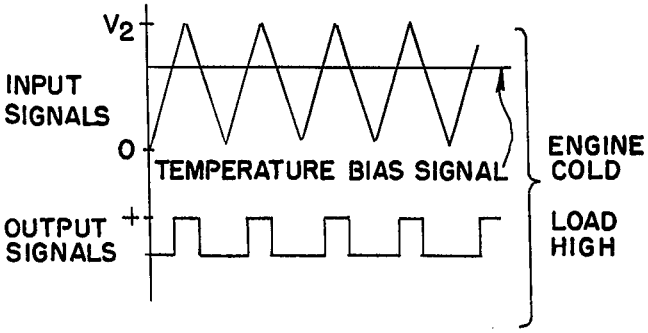

INCREASING WARM UP ENRICHMENT AS A FUNCTION OF MANIFOLD ABSOLUTE PRESSURE

BACKGROUND OF THE INVENTION

1. Field of the Invention

The invention is related to the general field of electronic fuel control systems for internal combustion engines and, in particular, to that portion of the above field directed to metering fuel to the engine during the transient warm up period.

2. Description of the Prior Art

It is well known in the field of internal combustion engine fuel control systems that engine speed, absolute air intake manifold pressure, engine temperature, as well as other engine parameters, may be used to compute the desired fuel delivery to the engine under both steady state and transient modes of operation. In particular, the prior art has recognized the need for fuel enrichment during the transient warm up period of the engine and makes provisions for enriching the fuel/air mixture during this critical operational phase of the engine. The fuel enrichment compensates for incomplete vaporization of the fuel, for condensation of the delivered fuel on the cold surfaces of the intake manifold, and for the high frictional load of the cold engine. U.S. Pat No. 3,771,502 - "Circuit for Providing Electronic Warm Up Enrichment Fuel Compensation Which is Independent of the Intake Manifold Pressure in an Electronic Fuel Control System", by J. N. Reddy (Nov. 13, 1973) is indicative of the teachings of the prior art. The Reddy patent teaches warm up enrichment as a function of engine temperature independent of the pressure of the air being inhaled by the engine from the intake manifold. The enrichment during warm up may be a simple linear function of the difference between the actual engine temperature and the normal operating temperature or may be a more complex function of engine temperature, as taught by Yoshida et al in U.S. Pat. No. 3,816,717 - "Electrical Fuel Control System for Internal Combustion Engines"(June 11, 1974). The prior art has also recognized the requirement for enriching the fuel/air mixture being delivered to the engine under full load operating conditions. The Reddy patent cited above, as well as many others, teaches full load enrichment as a function of engine speed while the Yoshida et al patent above, and others, teaches full load enrichment as a function of the pressure in the engine's intake manifold.

Although the prior art has independently recognized the requirement of enriching the fuel/air mixture being delivered to the engine during the warm up period as a function of engine temperature and enriching the fuel-/air mixture during full load operation as a function of pressure in the engine's intake manifold, the prior art has treated these as independent variables and failed to recognize the requirement to provide increased warm up enrichment as a combined function of both intake manifold pressure and engine temperature. The requirement for an even greater fuel enrichment under high load operating conditions is attributable to several factors. One factor is that the rate of vaporization of fuel is much slower at higher manifold pressures than it is at the lower manifold pressures. This factor further increases the probability of nucleation rather than vaporization of the fuel as the quantity of injected fuel increases. These and other factors, which determine the quantity of fuel required during the warm up period of the engine, are will known to those skilled in the art. The disclosed invention is a warm up circuit providing increased enrichment as a function of both engine temperature and intake manifold pressure.

SUMMARY OF THE INVENTION

The invention is an electronic fuel control system for an internal combustion engine embodying, in addition to the conventional injection timing pulse generation circuits, a full load warm up enrichment circuit to provide additional fuel and compensate for inadequate fuel preparation when a cold engine is subjected to high loads. The full load warm up enrichment circuit controls the duration of the generated injection timing pulses in response to engine temperature below a predetermined value and further increases the duration of the generated injection timing pulses when the temperature is below the predetermined temperature and the engine load is above a predetermined load. The fuel control system comprises a storage means for storing an electrical charge, a current source charging the storage means and a circuit comparing the charge on the storing means with a determinable signal to generate an injection timing signal in the interval it takes to charge the storage means from a predetermined value to the value of the determinable signal. The full load warm up enrichment circuit includes a temperature bias circuit to generate a temperature bias signal, a load threshold circuit to generate a load threshold signal and a comparator for comparing the load threshold signal with said temperature bias signal to control the rate at which said storage means is charged by the current source. In the preferred embodiment the full load warm up enrichment circuit is a current sink sinking a portion of the current generated by the current source as a function of both engine temperature and engine load.

The objective of the invention is an electronic fuel control system providing for full load warm up fuel enrichment required by a cold engine being subjected to high operating loads. Another objective of the invention is an electronic fuel control unit embodying a full load warm up fuel enrichment circuit for encreasing the fuel delivery to the engine in response to engine temperatures below a predetermined value and engine loads above predetermined loads. These and other objectives of the invention will become evident from a reading of the specification and the appended claims.

BRIEF DESCRIPTION OF THE DRAWINGS

FIG. 6 is a block diagram showing the basic elements of the disclosed fuel control system.

FIG. 7 is a block diagram of an alternate embodiment further detailing the system illustrated in FIG. 6.

FIG. 8 is a block diagram of the preferred embodiment further detailing the system illustrated in FIG. 6.

FIG. 11 is a graph showing the output of the temperature bias circuit.

FIG. 12 is a graph illustrating the output of the load threshold circuit and the saw tooth wave generator.

FIG. 13*a* illustrates the input and the output waveforms for the comparator for a warm engine with a light load.

FIG. 13*b* illustrates the input and output waveforms for the comparator for a cold engine and a light load.

FIG. 13*c* illustrates the input and output waveforms for the comparator for a cold engine and a high load.

FIG. 14 is a graph of the sink current as a function of engine load for various engine temperatures.

DETAILED DESCRIPTION OF THE PREFERRED EMBODIMENT

Figure 1:
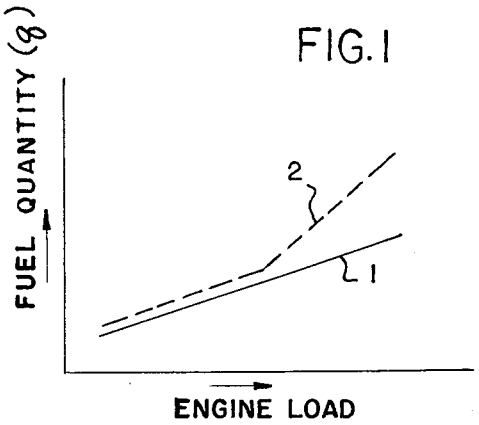
FIG. 1 is a graph of the fuel quantity required by an internal combustion engine as a function of engine loed.

The basic fuel requirement of an internal combustion engine operating at its normal operating temperature ($t_n$) is illustrated on FIG. 1. The quantity of fuel (q) required per engine cycle or per injection in a fuel injection equipped engine system is plotted as a function of engine load. Either engine speed or intake manifold pressure may be utilized as a measure of engine load, as discussed relative to the cited Reddy or Yoshida patents. Those skilled in the art are well aware that the relationship between the quantity of fuel (q) and the engine load may be linear function, as indicated by the line segment 1 or may be a more complex function providing fuel enrichment at the high engine loads, as indicated by the segmented curve 2. The segment curve 2 is indicative of the fuel delivery schedules of current fuel control systems, as taught by the cited prior art.

Figure 2:
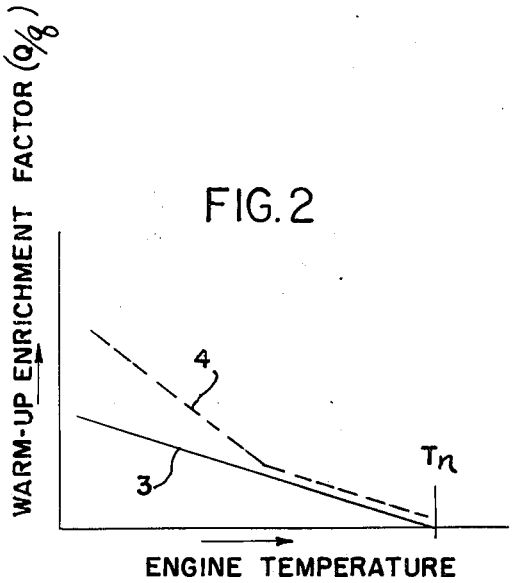
FIG. 2 is a graph of the warm up fuel enrichment factor (Q/q) as a function of the engine temperature.

The enrichment factor required for satisfactory operation of a cold engine as a function of engine temperature is illustrated in FIG. 2. The enrichment factor may be a linear function of the engine temperature, as illustrated by curve 3, or may be segmented, as illustrated by curve 4. The enrichment factor (Q/q), as determined by curve 3 or 4, becomes zero at the normal operating temperature ($t_n$) of the engine.

Figure 3:
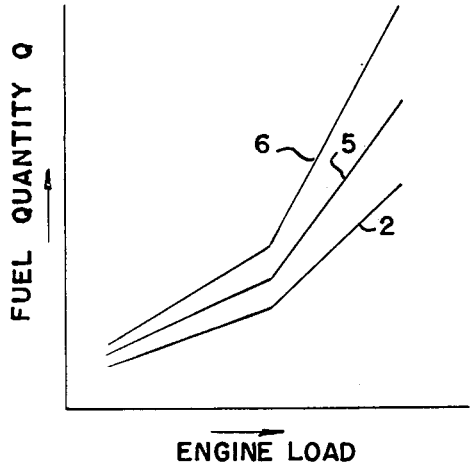
FIG 3 is a graph of the fuel quantity required as a function of engine load for selected engine temperatures.

In accordance with the teachings of the prior art, the quantity Q of fuel required by the engine during the warm up period as a function of engine load is illustrated in FIG. 3. The segmented curve 2 is the fuel requirement curve of FIG. 1 with the engine operating at is normal temperture. The segmented curves 5 and 6 are indicative of the engine's fuel requirements at engine temperature of less than the normal operating temperature. Segmented curves 5 and 6 are typical of the fuel delivery schedules provided by the prior art.

Figure 4:
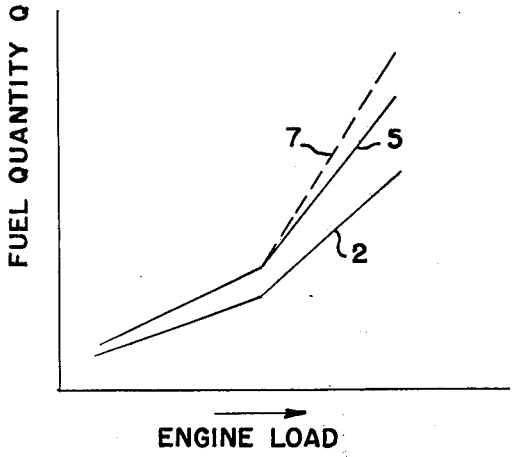
FIG. 4 is a graph illustrating the full load warm up enrichment provided by the disclosed system.

However, under high load, cold engine operating conditions a still further enrichment is required to compensate for inadequate fuel preparation prior to being inhaled into the combustion cylinders. This type of warm up enrichment illustrated in FIG. 4 is a function of both engine temperature and engine load. Again, the segment curve 2 is indicative of the engine's fuel requirements at its normal operating temperature. Segmented curve 5 is indicative of the warm up enrichment provisions of the prior art, as illustrated in FIG. 3. The dashed line 7 is indicative of the increased enrichment required under the higher engine loads in accordance with the teachings herein. Although the load dependent warm up enrichment of curve 7, as illustrated, is beginning at the same engine load as the conventional load enrichment, the load at which load dependent warm up enrichment begins may be different in accordance with the engine requirements.

Figure 5:
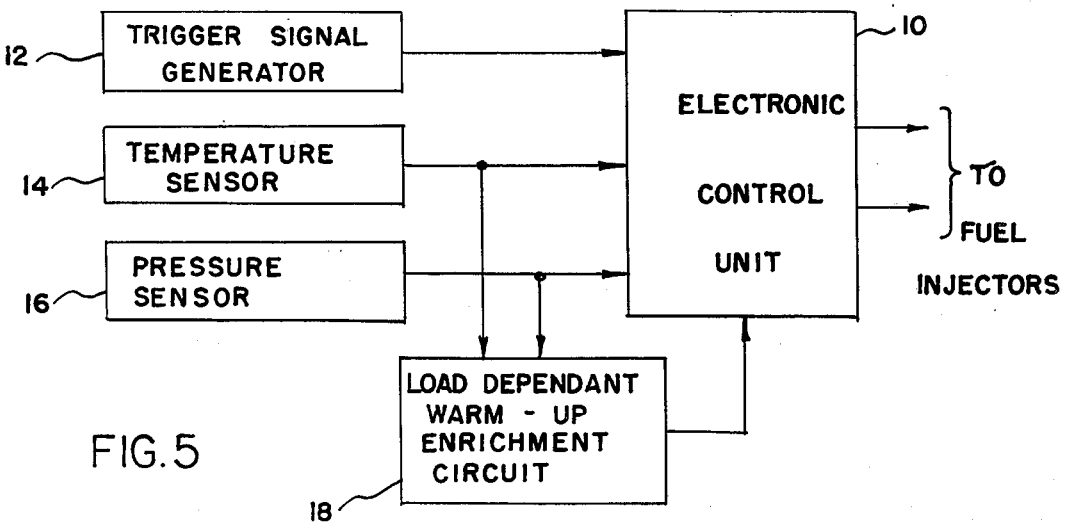
FIG. 5 is a block diagram of the disclosed electronic fuel control system embodying the load dependent warm up fuel enrichment circuit.

A block diagram embodying the load dependent warm up enrichment indicative of curve 7 of FIG. 4 is illustrated in FIG. 5. The electronic fuel control system comprises an electronic control unit 10 receiving input signals from sensors generating signals indicative of the engine operating parameters, such as a trigger signal generator 12, the temperature sensor 14 and the pressure sensor 16. The electronic control unit 10 responds to the signals from the sensors shown, as well as others not shown and generates signals indicative of the engine's fuel requirements, as illustrated by either curve 1 or 2 in FIG. 1. To provide the load dependent warm up enrichment illlustrated by curve 7 of FIG. 4, the system includes a load dependent warm up circuit 18 receiving input signals from the temperature sensor 14 and a load sensor illustrated as pressure sensor 16 generating a signal indicative of the pressure in the engine's intake manifold. The load dependent warm up circuit 18 responds to the temperature signal and the pressure signals and generates a signal input to the electronic control unit which increases the fuel delivery to the engine during the warm up period when the engine is operating at a load greater than a predetermined load.

The details of the load dependent warm up circuit 18 and the electronic control unit 10 and their interrelationship is illustrated in further detail in FIG. 6. The electronic control unit 10 shown in FIG. 6 is of the type disclosed by Reddy in U.S. Pat. No. 3,734,068 - "Fuel Injection Control System" (May 22, 1973). This type of electronic control unit comprises a current source 20 charging a capacitor 22. It also includes a pulse generating circuit 24, a timing circuit 26 and a pluse distribution circuit 28. This electronic control unit, like that illustrated in FIG. 5, receives input signals from a temperature sensor 14 and trigger signal generator 12 and a pressure sensor 16. The system embodies warm up enrichment capabilities and is taught by Reddy in patent 3,771,502.

The operation of the electronic control unit 10 is as follows: The current source 20 generates a temperature dependent current which charges capacitor 22. The pulse generating circuit monitors the voltage on capacitor 22 and generates a pulse signal when the voltage on capacitor 22 reaches a predetermined level determined by the pressure in the intake manifold, as indicated by the signals received from pressure sensor 16. Timing circuit 16 receives trigger signals from the trigger signal generator 12 and generates timing signals which are applied to the pulse generating circuit 24 and the pulse distribution circuit 28. Timing signals applied to the pulse generating circuit synchronize the charging and discharging of capacitor 22 with the rotation of the engine. The pulse generating circuit generates an output signal which is a function of at least the engine temperature and the pressure in the intake manifold and may, as discolsed in the Reddy patents above, also be a function of the engine's speed. The output pulses from the pulse generating circuit indicative of the engine's fuel requirements and timing signals from the timing circuit are input into the pulse distribution circuit 28 which distributes the pulses to the respective fuel injectors associated with the engine. As is well known in the art, the pulse distribution circuit distributes the injection pulses to the individual fuel injectors. The distribution may be sequential or the distribution may divide the injection pulses between two alternating groups of injectors, as shown. The injection pulses are normally amplified by means of amplifiers, such as amplifiers 30 and 32, prior to being used to activate the fuel injectors.

The pressure dependent warm up enrichment circuit 18 comprises a load threshold circuit 34 receiving signals from the pressure sensor 16 indicative of the engine load, a temperature bias circuit 36 receiving signals from the temperature sensor 14 and a comparator circuit 40 receiving signals from the threshold circuit 34 and the temperature bias circuit 36. The output of the comparator circuit is applied to the current source 20 in the electronic control unit and is operative to control the output current of the current source during the warm up period as a function of both the engine's temperature and the pressure in the intake manifold when the engine is cold and operating under loads higher than a load predetermined by the load threshold circuit.

The operation of the load dependent warm up fuel enrichment circuit is as follows: Pressure signals indicative of the engine load are applied to the load threshold circuit 34 which generate a load dependent output signal when the pressure is indicative of a load above a predetermined level. Temperature signals indicative of the engine temperature are applied to the temperature bias circuit which generates temperature bias signal when the engine temperature is below a predetermined temperature. The comparator circuit 40 compares the signals from the pressure threshold circuit 34 and the temperature bias circuit 36 and generates an output signal indicative of the increased warm up enrichment required to satisfy the fuel requirements of the engine during the warm up and the high load conditions. The signal from the comparator circuit 40 is applied to the current source and controls the output of the current source when the engine is cold and operating under a high load.

A specific implementation of the load dependent warm up fuel enrichment circuit and its interrelationship with the control current source 20 is illustrated in FIG. 7. As previously illustrated with reference to FIG. 6, the load dependent warm up enrichment circuit comprises a load threshold circuit 34 receiving a load signal from a pressure sensor 16. The load threshold circuit generates an output signal which has a constant value for input pressure signals below a predetermined level and a signal which is inversely proportional to the load when the load is above a predetermined value. The output of the load threshold circuit is input to a sawtooth wave generator 38 which generates a sawtooth wave having a predetermined minimum value and a peak value directly proportional to the value of the output signal of the threshold circuit. The sawtooth wave is input into one terminal of a comparator 40. The other terminal of the comparator 40 is biased by the signal from a temperature bias circuit 36 receiving a signal from the temperature sensor 14. The output of a comparator is applied to a current source control circuit 44 which controls the value of the output current from the current source 46 to the capacitor 22. In the embodiment of FIG. 7 of the current source, control 44 also receives an input from the temperature sensor 14 which is used to provide the normal warm up enrichment control of the output current from the current source 46.

One skilled in the art will immediately recognize that the current source control 44 may take different forms and be controlled in various other ways. A simplified configuration is shown in FIG. 8. In this alternate configuration a signal from the temperature sensor is input directly to the temperature biased circuit which establishes a bias potential for the comparator 40. In this configuration the signals are adjusted so that the signals from the comparator 40 directly control the current source 46 and provides the normal warm up enrichment, eliminating the requirement for the current source control 44 illustrated in the embodiment of FIG. 7.

Figure 9:
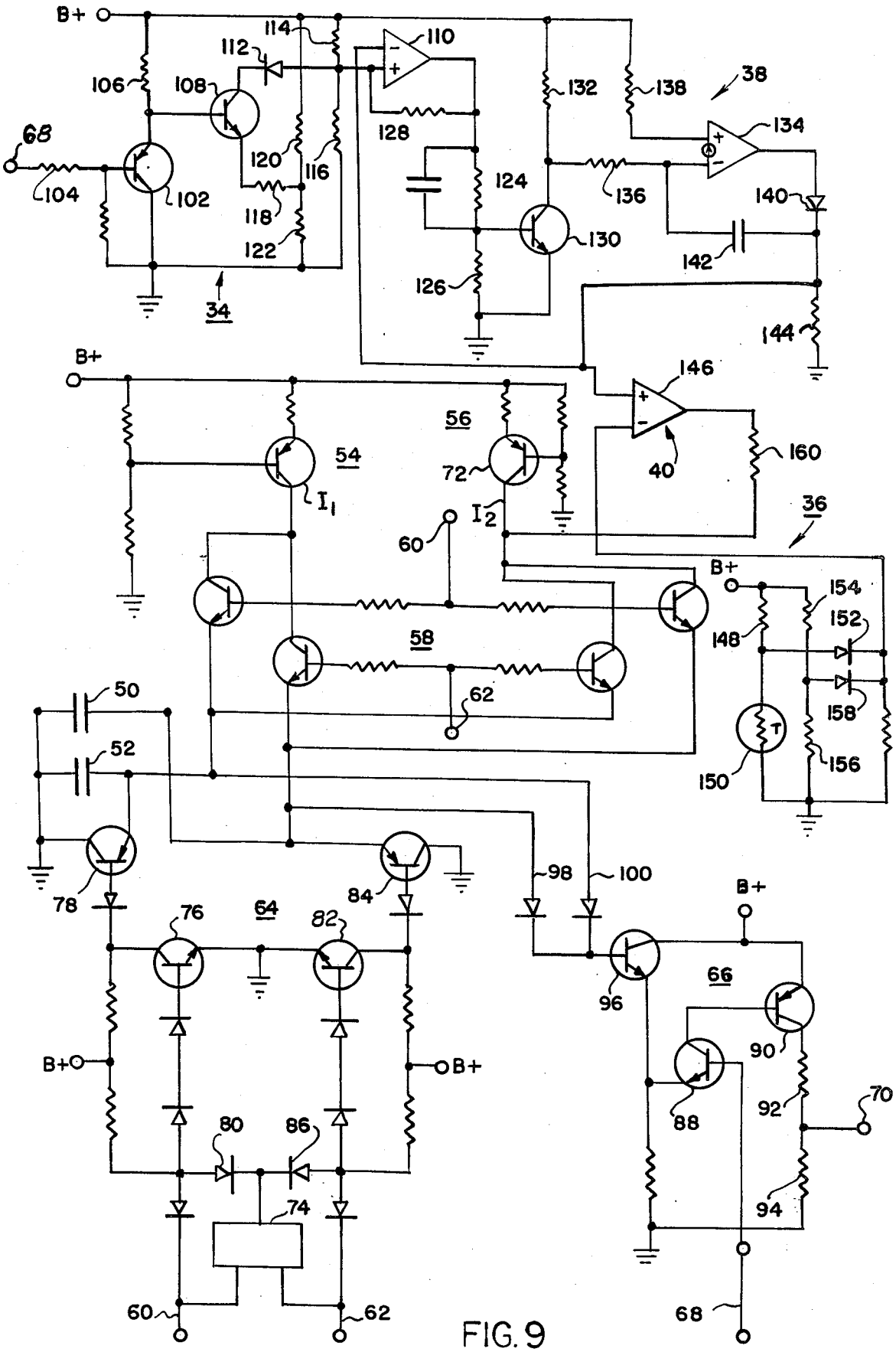
FIG. 9 is a circuit diagram of the preferred embodiment.

A circuit implementation of the load dependent warm up fuel enrichment circuit 18 of the type illustrated in FIG. 8 in combination with an electronic control unit 10 of the type disclosed by Reddy in U.S. Pat. No. 3,734,068 - "Fuel Injection Control System", is shown in FIG. 9. The circuit is powered from a source of electrical energy designated at various points on the diagram as B+. The source of electrical power may be a battery or engine driven source, such as an alternator or generator conventionally associated with an internal combustion engine. The electronic control unit 10 is illustrated as having two capacitors 50 and 52 alternately charged by means of a pair of current sources 54 and 56 under the control of a switching network 58. The switching network receives trigger signals at input terminals 60 and 62 from a timing circuit, such as timing circuit 26 (not shown).

The pulse generating circuit 24 comprises a discharge circuit 64 and a comparator circuit 66. The discharge circuit 64 receives timing signals from the timing circuit at input terminals 60 and 62 while the comparator circuit 66 receives a load signal at terminal 68, such as a signal from pressure sensor 16 generating a signal indicative of the pressure in the engine's air intake manifold. The comparator 66 generates an output pulse signal at terminal 70 indicative of the engine's fuel requirements in response to the potentials on capacitors 50 and 52 and the value of the pressure signal.

Figure 10:
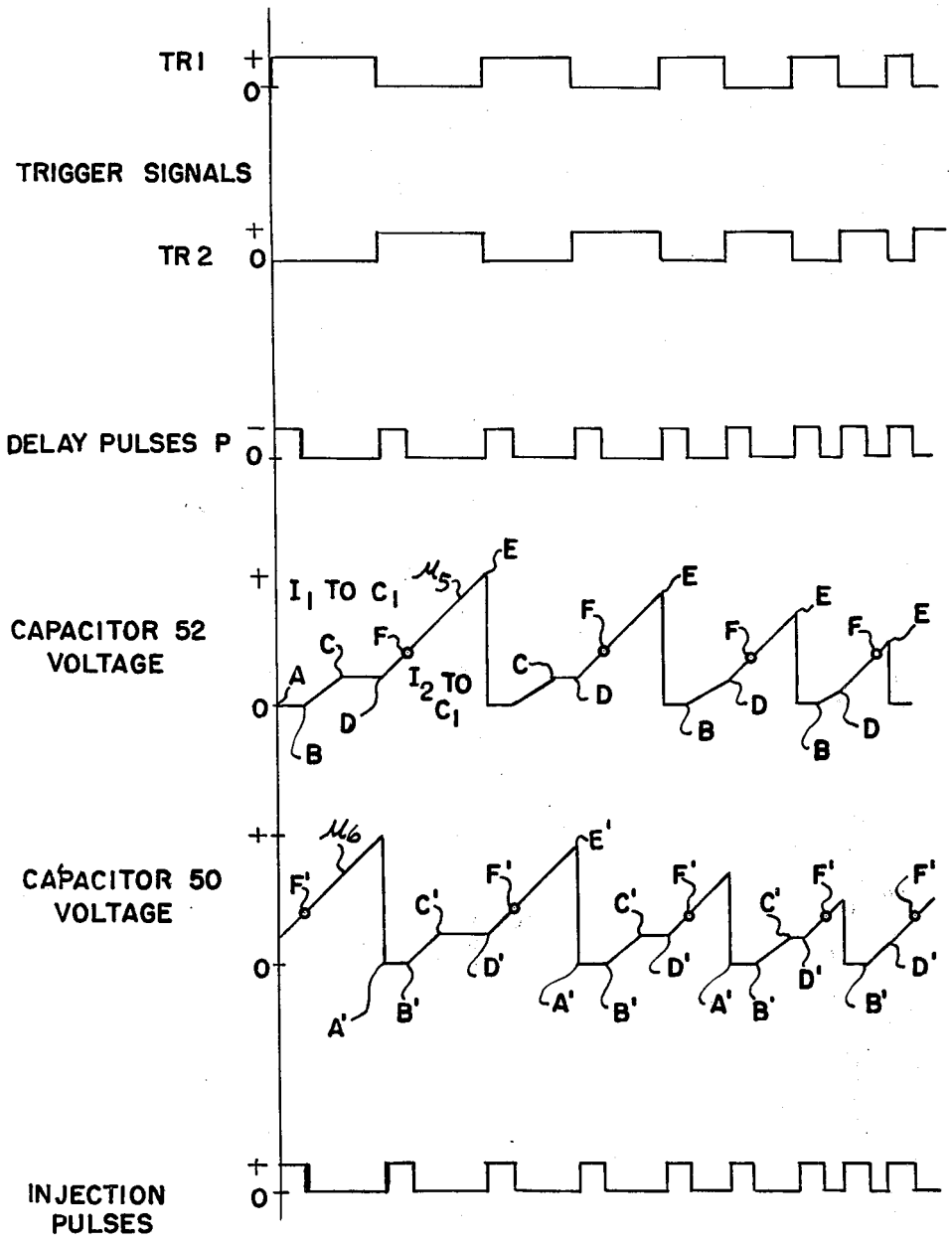
FIG. 10 illustrates the wave forms at various points in the circuit shown in FIG. 9.

The operation of the electronic control unit is discussed with reference to FIG. 9 and the wave forms shown on FIG. 10. Current source 54 is a constant current source capable of charging capacitors 50 and 52 at a predetermined rate to a predetermined value. Current source 56 is also a constant current source having a constant current output signal operative to charge capacitors 50 and 52 at a predetermined rate to potentials well above the predetermined value of current source 54. The trigger signals TR1 and TR2 in the form of two alternating square waves, as illustrated in FIG. 10, are respectively applied to input terminals 60 and 62 of switch 58 and control the sequential charging of the capacitors 50 and 52 by the two current sources 54 and 56. In the interval when the signal TR1 is positive and the signal TR2 is negative or a ground potential, capacitor 52 is charged by current source 54 and capacitor 50 is charged by current source 56. When the trigger signals reverse polarity, the two capacitors are charged by the alternate current source.

The leading edges of the trigger pulses TR1 and TR2 applied to the discharge circuit 64 activates a delay pulse generator 74, such as a single shot multivibrator which generates a delay pulse "p" having a predetermined pulse width significantly shorter than pulse width of the trigger pulse. A positive trigger signal on input terminal 60 coincident with the positive delay pulse signal "p" removes the effective ground potential on the base of transistor 76 causing it and transistor 78 to conduct. Transistor 78 discharges capacitor 52 to near ground potential during the period of the delay pulse. Termination of the delay pulse returns a ground potential at the output of the delay pulse generator 74 which is applied to the base of transistor 76 through diode 80. The ground signal at its base blocks transistor 76 which in turn blocks transistor 78 permitting capacitor 52 to be charged by current source 54 to the predetermined value. When the trigger signals TR1 and TR2 change polarity, a positive potential is applied to terminal 62 and the delay pulse "p" permits the base of transistor 82 to be forward biased and capacitor 50 is discharged by means of transistor 84 in a manner equivalent to the way capacitor 52 was discharged. The switching network 58 also changes state in response to the inversion of the trigger signals and capacitor 52 is charged from current source 56 and capacitor 50 is charged from current source 54.

The pressure signal applied to pressure input terminal 68 forward biases transistor 88 which in turn forward biases transistor 90. The conductance of transistor 90 produces a positive potential at output terminal 70 which is connected to the junction between resistances 92 and 94 forming a voltage divider network between the collector of transistor 90 and ground. The conductance of transistor 88 also biases the emitter of transistor 96 to a potential approximately equal to the value of the pressure signal appearing at terminal 68. The charge signals on capacitor 50 and 52 are applied to the base of transistor 96 through diodes 98 and 100, respectively. When the signals on both capacitors have a potential value below the value of the pressure signal, transistor 96 is blocked. However, when the potential value on either capacitor 50, 52 or both exceed the value of the pressure signal, transistor 96 conducts. Conductance of transistor 96 raises the value of the potential appearing at the emitter of transistor 88 above the value of the pressure signal applied to its base thereby blocking transistor 88. Blocking of transistor 88 blocks transistor 90 and with transistor 90 in the blocked state, the potential at output terminal 70 assumes a ground potential terminating the output signal.

The voltage wave forms generated across capacitors 50 and 52 in response to a series of trigger signals TR1 and TR2 and the delayed pulse "p", are shown on FIG. 10. The decreasing period of the sequential trigger signals illustrated is an exaggerated example of the change in the pulse width of the trigger signals as a function of engine speed. Referring to the wave form for capacitor 52, the initial segment from A to B is generated when TR1 is positive and the delay pulse generating circuit is producing a delay pulse "p" discharging capacitor 52. Upon termination of the delay pulse "p", point B, capacitor 52 begins to charge at a rate determined by current source 54 to its predetermined value indicated as point C. The charge on capacitor 52 remains at the predetermined value for the remainder of the positive portion of the trigger signal TR1. At point D the trigger signals TR1 and TR2 reverse polarity and capacitor 52 is now charged by the current source 56 during the interval from D to E which is equal to the interval when the trigger pulse TR2 is positive.

When the charge on either capacitor 50 or 52 is above the value of the signal applied to the emitter of transistor 96, the signal at the output terminal 70 is a ground potential. At the occurrence of a trigger signal, the capacitor which was being charged by current source 56 is discharged to approximately ground potential by the discharge circuit 64 and the charge on the capacitor being charged by current source 54 is below the value of the signal applied to the emitter of the transistor 96, which is indicative of the value of the pressure signal. Since the charge on both capacitors is below the value of the pressure signal, transistor 96 is blocked, which renders transistors 88 and 90 conductive generating a positive signal at output terminal 70 having a value determined by the respective value of resistances 92 and 94. The signal at output terminal 70 remains positive until the charge on the capacitor being charged by current source 56 exceeds the value of the pressure signal. When the charge on the capacitor exceeds the value of the pressure signal, point F on the segment DE, transistors 88 and 90 become blocked and the signal at the output terminal 70 returns to ground potential. The time interval when the signal at output terminal 70 is positive, is indicative of the engine's fuel requirements as a function of engine speed and the pressure in the intake manifold.

Referring back to FIG. 9, the circuit details of the load dependent warm up enrichment circuit 18 will be explained. Input terminal 68 receives a load signal from the pressure sensor 16. Terminal 68 is connected to the base of transistor 102 by means of a resistance 104. The collector of transistor 102 is connected to ground and the emitter of transistor is connected to B+ by means of a resistance 106. The emitter of transistor 102 is also connected to the base of transistor 108. The collector of transistor 108 is connected to the positive terminal of a comparator 110 by means of a diode 112. The positive terminal of the comparator 110 is biased by means of a resistance divider network comprising resistance 114 and 116. The emitter of transistor 108 is connected by means of resistance 118 to the center point of a voltage divider network comprising resistances 120 and 122. Comparator 110 has an uncommitted npn collector output which is connected to ground through a resistance divider network comprising resistances 124 and 126. The uncommitted output of the comparator is also connected back to the positive input terminal of comparator 110 by means of resistance 128. The base of transistor 130 is connected to the junction between resistance 124 and 126 in circuit relationship with the output terminal of comparator 110. The emitter of transistor 130 is connected to ground and the collector of transistor 130 is connected to B+ by means of resistance 132. The collector of transistor 130 is also connected to a Norton Operational Amplifier 134 by means of a resistance 136. The positive terminal of the Norton Operational Amplifier 134 is connected to B+ through a resistance 138. The output of the Norton Operational Amplifier is connected to the negative input terminal of the Norton Amplifier by means of diode 140 and capacitance 142. The junction between diode 140 and capacitance 142 is connected to ground through resistance 144 to the negative input terminal of comparator 110 and to the positive input terminal of a comparator 146.

The negative input terminal of the comparator 146 is connected to a temperature bias circuit 36 comprising a resistance 148 in series relationship with the temperature sensor 14 shown as thermistor 150 between B+ and ground. The junction between resistance 148 and the thermistor 150 is connected to the negative input terminal of comparator 146 by means of diode 152. This divider circuit is paralleled by a low limit circuit comprising resistances 154 and 156 serially connected between B+ and ground. The junction between resistances 154 and 156 is also connected to the negative terminal of the comparator 146 by means of diode 158. The output of comparator 146 is connected to the collector of transistor 72 in the current source 56 by means of resistance 160.

The operation of the load dependent warm up enrichment circuits are as follows: Considering first the temperature biased circuit, when the temperature of the engine is above a predetermined temperature indicative of normal operating temperatures for the engine, the resistance of the thermistor 150 is low and the potential appearing at the junction between thermistor 150 and resistance 148 is lower than the potential between the junction of resistances 154 and 156 of the low limit circuit. The value of resistances 154 and 156 are selected so that when the engine is warm, the potential at their junction is lower than the lowest potential applied to the positive input terminal to comparator 146 by the sawtooth wave generator. The potential appearing at the junction of resistances 154 and 156 is applied to the negative input terminal of comparator 146 by means of a diode 158 and renders comparator 146 nonresponsive to the sawtooth wave appearing at the positive input terminal. When the temperature of the engine is low (cold), the resistance of the thermistor 150 is high and, therefore, the potential at the junction between thermistor 150 and resistance 148 is higher than the potential between the junction of resistances 154 and 156 and is communicated by means of diode 152 to the negative terminal of the comparator 146. By this means the potential at the negative input of comparator 146 is dependent upon the temperature of the engine only when the engine temperature is below a predetermined value, as illustrated on FIG. 11.

The operation of the load threshold circuit 34 is as follows: The pressure signal is applied to the base of transistor 102 from input terminal 68 causing the transistor 102 to conduct. The potential appearing at the emitter of transistor 102 is approximately equal to the value of the pressure signal applied to the input terminal 68. The signal appearing at the emitter of transistor 102 is applied to the base of transistor 108 while the emitter of transistor 108 is biased by the potential appearing at the junction between resistances 120 and 122. When the pressure signal appearing at the input terminal 68 is lower than the threshold value determined by the divider network comprising resistances 120 and 122, transistor 108 is blocked and the potential at the input of the comparator 110 is determined by the potential at the junction between the resistances 114 and 116. When the pressure signal appearing at input terminal 68 is greater than the threshold value appearing between resistances 120 and 122, transistor 108 conducts forming a current path parallel to resistance 116 and the potential at the positive terminal comparator 110 becomes an inverse function of the pressure signal, as illustrated on FIG. 12.

The output signal of the load threshold circuit 34 is applied to the positive input terminal of comparator 110 in the sawtooth wave generator 38. The operation of the sawtooth wave generator 38 is as follows: When the value of the signal at the negative terminal of comparator 110 is less than the value of the signal at the positive terminal, the output of comparator 110 is uncommitted and a bias current is supplied to the base of transistor 130 from the B+ supply through resistances 114, 128 and 124. This base current causes transistor 130 to be in the conductive state and its collector assumes a near ground potential. The near ground potential at the collector of transistor 130 reduces the current flow to the negative terminal of the Norton Operational Amplifier 134 from B+ through resistances 132 and 136. The signal stored on capacitor 142 then discharges through the negative input of the Norton Amplifier 134. The Norton Operational Amplifier produces an output signal which through diode 140 charges capacitor 142 in a direction opposite its initial polarity. The potential across capacitance 142, which continues to rise as the capacitor is charged by the output of the Norton Operational Amplifier, is communicated to the negative input terminal of the comparator 110. When the potential across capacitor 142 has a value greater than the potential input terminal of comparator 110, the comparator 110 changes state and a ground signal is produced at the output terminal. This ground signal applied to the junction between resistances 124 and 128 places resistance 128 in parallel with resistance 116 to ground and lowers the potential applied to the positive input terminal of comparator 110 and terminates the bias current applied to the base of transistor 130. Termination of the bias current to the base of transistor 130 renders this transistor nonconductive and a positive potential now appears at its collector. The positive signal at the collector of transistor 130 increases current to flow to the negative input terminal of the Norton Operational Amplifier 134 from the B+ supply through resistances 132 and 136. This current flow starts to recharge capacitor 142 to its initial state causing the potential at the negative terminal to become more positive. As the current signal to the negative input to the Norton Operational Amplifier increases, its output signal decreases and the potential across capacitance 142 begins to decay producing a decaying positive signal at negative input terminal of comparator 110. When the signal at the negative input of comparator 110 has decayed to a value less positive than the signal at the positive input terminal to comparator 110, comparator 110 changes state. The ground signal produced at the output of comparator 110 is terminated and the bias current is restored to the base of transistor 130 completing the operational cycle of the sawtooth generator. The signal generated across capacitance 142 is a sawtooth wave having a peak value determined by the potential applied to the positive input terminal of comparator 110 from the load threshold circuit 34 and a minimum value determined by the potential between resistances 120 and 122. This sawtooth wave is applied to the positive input of comparator 146.

Comparator 146, like comparator 110, has an uncommitted npn collector which functions as a current sink for the current signal produced by current source 56. The output of the comparator 146 is uncommitted during the interval of the sawtooth wave when the value of the sawtooth wave is greater than the value of the signal from the temperature biased circuit. However, during that portion of the cycle when the value of the sawtooth wave is less than the value of the signal from the temperature biased circuit, the output signal comparator 146 is a ground signal which sinks current from current source 56 through resistance 160. As previously indicated, when the engine is warm, the value of the signal from the temperature bias circuit is less than the lowest value of the signal generated by the sawtooth wave generator and, therefore, nonresponsive to changes in the shape of the generated sawtooth wave appearing at the positive input to comparator 146, as shown on the wave forms of FIG. 13*a*. The wave forms of FIG. 13*b* are indicative of the input and output signals of comparator 146 for a cold engine and a light load and the wave forms of FIG. 13*c* shows a cold engine and a high load. When the engine is cold and the load is light, the biased potential at the negative terminal comparator 146 has a determinable value and the peak voltage of the sawtooth wave at the positive terminal has its maximum value. In this state, a significant portion of the sawtooth wave has a value greater than the bias potential applied to the negative terminal, therefore, the comparator 146 will sink current from the current source 56 as a function of the temperature signal only. It is also seen that as the pressure in the intake manifold of the engine increases indicative of higher loads, the peak voltage of the sawtooth wave generated by the sawtooth wave generator decreases, as shown on FIG. 12, therefore, a greater portion of the sawtooth wave is now below the temperature bias potential and comparator 146 will sink a greater amount of current from the current source 56. The quantity of the current sinked by the load dependent warm up enrichment circuit is a function of pressure and temperature is shown on FIG. 14 where curve "a" is indicative of a warm engine, curve "c" is indicative of a cold engine and "b" is indicative of an intermediate engine temperature colder than the predetermined engine temperature but not as cold as the engine of curve c.

Sinking a portiion of the current from current source 56 reduces a rate at which capacitor 50 or 52 is charged by current source 56 thereby extending the period of time which it takes for the capacitor to generate a charge sufficient to overcome the bias potential at the emitter of transistor 96 in comparator circuit 66. As previously explained, this period of time is indicative of the engine's fuel requirements.

The above description shows that the disclosed fuel control system is capable of meeting the stated objectives. First, the system is capable of providing warm up fuel enrichment as a function of engine temperature alone when the engine is operating under light loads. However, when the engine load exceeds a predetermined value during the warm up period, the system provides increased fuel enrichment as a function of both engine load and engine temperature. This increased enrichment provides the proper amount of fuel required for efficient and smooth operation of a cold engine under both low and high load operating conditions.

Although a fuel control system embodying a load dependent warm up enrichment circuit has been described with reference to a specific type of electronic control unit and is described with specific circuitry, it is not intended that the invention be limited to the circuits illustrated and described. One skilled in the art will readily recognize that the concept disclosed may be applied to other types of electronic control units and that the functions provided by this specific circuit illustrated and described herein need be performed by other circuits without departing from the spirit of the invention.

What is claimed is:

1. In combination with an internal combustion engine fuel injection control system of the type having an electronic control unit to control the open time of at least one electrically actuated fuel injection valve in response to operating parameters of the engine, including the rotation of the engine's crank shaft, the engine's temperature and the engine's load, the improvement wherein said electronic control circuit comprises:

means for generating a first pulse train which produces a pulse for each revolution of said engine crankshaft, the magnitude of the pulses of said first pulse train varying in a predetermined manner;

means for generating a control signal having a predetermined fixed value for temperature above a predetermined temperature and a value variable as a function of engine temperature and engine load for engine temperatures below said predetermined temperature and engine load above a predetermined value;

means for generating a second pulse train which produces a pulse for each revolution of said engine crankshaft 180° out of phase with the pulses of said first pulse train, the magnitude of the pulses of said second pulse train varying as a function of said control signal;

means for combining the pulses of said first and second pulse trains so that the beginning of a pulse from said second pulse train terminates a pulse from said first pulse train and the end of a pulse from said second pulse train initiates a pulse from said first pulse train;

means for generating a third pulse train having pulses which begin with the beginning of each pulse of said second pulse train and ends when each pulse of said second pulse train reaches a value determined by the engine load; and means for applying said third pulse train to said electrically actuated fuel injector valve to open said injector valve for the duration of each pulse of said third pulse train.

2. The combination of claim 1 wherein said internal combustion engine fuel injection control system includes a load sensor generating load signals indicative of the engine's load and a temperature sensor generating a temperature signal indicative of the engine's temperature, said means for generating a control signal includes means receiving said load signal for generating a load threshold signal having a constant magnitude for engine loads below said predetermined load value, and a magnitude variable as a function of engine load for engine loads greater than said predetermined load value;

means receiving said temperature signal for generating a temperature bias signal having a magnitude variable as a function of engine temperature below said predetermined temperature, and a fixed magnitude for engine temperatures above said predetermined temperature;

means for comparing said load threshold signal with said temperature bias signal to generate said control signal.

3. The combination of claim 2 wherein said means for generating a load threshold signal comprises:

threshold circuit means receiving said load signal for generating a regulator voltage signal having a fixed value for engine loads below said predetermined load, and a value variable as an inverse function of engine load for engine loads above said predetermined load; and sawtooth wave generator means for generating a sawtooth wave having a peak value corresponding to the value of said regulator voltage signal and a predetermined minimum value.

4. The combination of claim 3 wherein said means for comparing is an electronic comparator circuit means having a first input receiving said temperature bias signal, a second input receiving said sawtooth wave signal, and an output having a first state for all signals at said second input having values greater than the value of signals at said first input, and a second state for all signals at said second input having values less than the value of signals at said first input.

5. The combination of claim 4 wherein said sawtooth wave generator means includes circuit means for controlling the minimum value of said sawtooth wave to a value equal to the value of the fixed magnitude of said temperature bias signal.

6. The combination of claim 4 wherein said sawtooth wave generator means includes circuit means for controlling the minimum value of said sawtooth wave to a value greater than the value of the fixed magnitude of said temperature bias signal.

7. The combination of claim 4 wherein said means for generating a second pulse train includes storage means and a current source supplying an electrical current to said storage means to generate said second pulse train, said comparator circuit means is a current sink, having its output electrically disposed between said current source and said storage means, the output of said comparator being electrically uncommitted in said first state and a ground signal in said second state sinking current from said current source and controlling the magnitude of said second pulse train.

8. The combination of claim 7 wherein the internal combustion engine includes an air intake manifold, said load sensor is a pressure sensor generating a pressure signal indicative of the air pressure in the air intake manifold.

9. A fuel control system for controlling the fuel delivery to an internal combustion engine in response to engine operating conditions comprising:

means responsive to the rotation of the engine for generating trigger signals indicative of a first and a second portion of the engine's cycle of operation;

means for storing an electrical charge;

first circuit means for generating a first charge current to charge said storage means and generate a first cyclic signal having a value varying at a predetermined rate from an initial value to a threshold value at least once during each cycle of engine operation;

sensor means for generating a temperature signal indicative of the engine's temperature;

sensor means for generating a load signal indicative of the engine's load;

control circuit means receiving said temperature signal and said load signal for generating a control signal having a predetermined value for all engine temperatures above a predetermined temperature, a value that varies as a function of engine temperature for engine temperatures below said predetermined temperature and engine load below a predetermined load and as a function of both engine temperature and engine loads for engine temperatures below said predetermined temperature and engine loads above said predetermined engine load;

second circuit means receiving said control signal for generating a second charge current to charge said storage means and generate a second cyclic signal having a value that varies at a rate controlled by said control signal from said threshold value to a value significantly greater than said threshold value at least once during each cycle of operation;

switch means electrically disposed between said first circuit means and said second circuit means and said storage means for controlling in response to said trigger signal the sequential charging of said storage means by said first current circuit means during one portion of the engine's cycle of operation and by said second circuit means during the other portion of the engine's cycle of operation;

third circuit means receiving said load signal and said second cyclic signal for generating a first output signal when the value of said load signal is greater than the value of said cyclic signal and a second output signal when the value of said load signal is less than said second cyclic signal; and fuel delivery means including at least one fuel injector valve responsive to said trigger signals and the output signals from said third circuit means for providing fuel to the engine for a period of time determined by the time said circuit means is producing said first output signal.

10. The fuel control system of claim 9 wherein said control circuit means includes:

means receiving said temperature signal for generating a temperature bias signal having a predetermined value in response to temperature signals indicative of an engine temperature above said predetermined temperature and a variable value varying from said predetermined value as an inverse function of temperature for temperature signals indicative of temperatures below said predetermined temperature;

means receiving said load signal for generating a load threshold signal having a predetermined value in response to load signals indicative of loads less than said predetermined load and a variable value varying from said predetermined value as a function of load, for signals indicative of engine loads above said predetermined load; and means for comparing said load threshold signal with said temperature bias signal to generate said control signal.

11. The control system of claim 10 wherein said means for generating a load threshold signal comprises:

threshold circuit means receiving said load signal for generating a regulator voltage signal having a fixed value for load signals indicative of engine loads below said predetermined load, and a value variable as a function of said load signals indicative of engine loads above said predetermined load; and sawtooth wave generator means for generating a sawtooth wave having a predetermined minimum value, and a peak value corresponding to the value of said regulator voltage signal.

12. The control system of claim 11 wherein said means for comparing is an electronic comparator circuit means having a first input receiving said temperature bias signal, a second input receiving said sawtooth wave signal, and an output having a first state for all portions of said sawtooth wave having values greater than the value of said temperature bias signal, and a second state for all portions of said sawtooth wave having values less than the values of said temperature bias signal.

13. The control system of claim 12 wherein said sawtooth wave generator means includes circuit means for controlling the minimum value of said sawtooth wave to a value equal to the predetermined value of said temperature bias signal.

14. The combination of claim 12 wherein said sawtooth wave generator means includes circuit means for controlling the minimum value of said sawtooth wave to a value greater than the value of the predetermined value of said temperature bias signal.

15. The control system of claim 12 wherein said comparator circuit means is a current sink, having its output electrically disposed between said second circuit means and said means for storing an electrical charge, the output of said comparator being electrically uncommitted in said first state and a ground signal in said second state sinking current generated by said second circuit means and controlling the rate at which the value of said second cyclic signal varies.

16. The control system of claim 15 wherein the internal combustion engine includes an air intake manifold and the air pressure in said intake manifold is indicative of the engine's load, said load sensor is a pressure sensor generating a pressure signal indicative of the air pressure in the engine's air intake manifold.

17. The control system of claim 10 wherein said means for storing includes a first capacitance and a second capacitance and wherein said switch means in response to said trigger signal indicative of said first portion of the engine's cycle of operation switches said first circuit means to charge said first capacitance and said second circuit means to charge said second capacitance and in response to the trigger signal indicative of the second portion of the engine's cycle of operation switches said first circuit means to charge said second capacitance and said second circuit means to charge said first capacitance.

18. In combination with an electronic fuel control system for an internal combustion engine, said fuel control system having engine sensor means generating signals indicative of the engine's operating conditions, said sensor means including a temperature sensor generating a temperature signal indicative of the engine's temperature and a load sensor generating a load signal indicative of the engine's load, an electronic control unit for generating injector signals indicative of the engine's fuel requirements as a function of the engine's temperature, engine load, and other operating conditions in response to input signals and the signals generated by the engine sensor means, and at least one electrically actuated injector for delivering fuel to the engine in response to said injector signals, an improvement for generating an input signal for the electronic control unit to further increase the fuel delivery to the engine during the warm-up period when the engine load exceeds a predetermined load comprising:

circuit means receiving said temperature signal and said load signal for generating an input signal operative to increase fuel delivery to said engine as an inverse function of only the engine's temperature in response to temperature signals indicative of an engine's temperature below a predetermined temperature and load signal indicative of loads below a predetermined load, and operative to increase fuel delivery to the engine as a function of both engine temperature and engine load in response to temperature signals indicative of temperatures below said predetermined temperature and load signals indicative of engine loads above said predetermined load.

19. The improvement of claim 18 wherein said circuit means includes:

a temperature bias circuit receiving said temperature signal for generating a temperature bias signal, said temperature bias signal having a value, variable as an inverse function of temperature for temperature signals indicative of an engine's temperature below said predetermined temperature, and a constant value for temperature signals indicative of an engine's temperature above said predetermined temperature;

a load threshold circuit receiving said load signal for generating a load threshold signal, said load threshold signal having a first constant value for load signals indicative of an engine's load below said predetermined load and a second value variable as a function of the load signal for load signals above said predetermined load; and means for comparing said temperature bias and said load threshold signals to generate said input signal.

20. The improvement of claim 19 wherein said load threshold circuit includes:

threshold circuit means receiving said load signal for generating a regulator signal, said regulator signal having a first constant value for load signals indicative of an engine's load below said predetermined load, for a second value, variable as an inverse function of the engine load for load signals indicative of engine loads above said predetermined load; and a sawtooth wave generator generating a sawtooth wave signal having a predetermined minimum value and a peak value corresponding to the value of said regulator signal.

21. The improvement of claim 20 wherein said electronic control unit includes at least one capacitance and a current source for generating a current signal charging said capacitor at a determinable rate, and wherein the engine's fuel requirements are determinable from the time it takes the current source to charge the at least one capacitor to a determinable value, said means for comparing is a current sink electrically disposed between said current source and said capacitance for sinking a portion of the current signal generated by said current source at a rate proportional to the value of said temperature bias signal and inversely proportional to the peak value of said sawtooth wave.

22. The improvement of claim 21 wherein said current sink means is an electronic comparator circuit having a positive input terminal, a negative input terminal and an uncommitted npn collector output terminal, said comparator receiving said sawtooth wave form at said positive input terminal, said temperature bias signal at said negative input terminal, and generating a ground signal at said output terminal during the intervals said sawtooth wave has a value less than the value of said temperature bias signal.

23. The improvement of claim 19 wherein said internal combustion engine has an air intake manifold supplying air to the engine, and the air pressure in the intake manifold is indicative of the engine load, said load sensor is a pressure sensor generating a pressure signal indicative of the pressure in the intake manifold of the engine.

* * * * *

UNITED STATES PATENT OFFICE

CERTIFICATE OF CORRECTION

Patent No. 3,971,354 Dated July 27, 1976

Inventor(s) David G. Luchaco and William A. Peterson, Jr.

It is certified that error appears in the above-identified patent and that said Letters Patent are hereby corrected as shown below:

Col. 2, line 1, delete "will" and insert therefor ---well---;

Col. 2, line 42, delete "encreasing" and insert therefor ---increasing---;

Col. 2, line 52, delete "loed" and insert therefor ---load---;

Col. 3, line 53, delete "temperature" and insert therefor ---temperatures---;

Col. 4, line 61, delete "discolsed" and insert therefor ---disclosed---;

Col. 11, line 31, delete "is" and insert therefor ---as---;

Col. 11, line 37, delete "portiion" and insert therefor ---portion---;

Col. 14 (Claim 9) line 30, before the word "circuit" insert ---third---;

Col. 14 (Claim 10) line 48, before signals, insert ---load---;

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*